US009823036B2

(12) United States Patent
Casey et al.

(10) Patent No.: US 9,823,036 B2
(45) Date of Patent: Nov. 21, 2017

(54) FIREARM CLEANING TOOL

(71) Applicant: Workshops for Warriors, San Diego, CA (US)

(72) Inventors: Michael Casey, El Cajon, CA (US); Hernán Luis y Prado, San Diego, CA (US)

(73) Assignee: Workshops for Warriors, San Diego, CA (US)

( * ) Notice: Subject to any disclaimer, the term of this patent is extended or adjusted under 35 U.S.C. 154(b) by 0 days.

(21) Appl. No.: 15/130,791

(22) Filed: Apr. 15, 2016

(65) Prior Publication Data

US 2016/0305731 A1 Oct. 20, 2016

Related U.S. Application Data

(60) Provisional application No. 62/148,124, filed on Apr. 15, 2015.

(51) Int. Cl.
*F41A 29/00* (2006.01)
*F41A 29/02* (2006.01)

(52) U.S. Cl.
CPC ..... *F41A 29/02* (2013.01)

(58) Field of Classification Search
CPC ..... F41A 29/00; F41A 29/02; F41C 27/00; F41G 1/545
USPC ..... D8/16, 17, 19
See application file for complete search history.

(56) References Cited

U.S. PATENT DOCUMENTS 489,606 A * 1/1893 Geneste ..... F41A 29/02 15/104.16
D116,179 S * 8/1939 Yates, Jr. ..... D8/17
6,230,430 B1 * 5/2001 Gosselin ..... F41C 27/00 42/90
7,644,529 B2 1/2010 Hopper
8,327,571 B2 12/2012 Jaquish
8,474,171 B1 * 7/2013 Simmons ..... F41A 11/04 42/108
8,528,144 B2 9/2013 Oselinsky
2009/0178324 A1 7/2009 Hopper
(Continued)

FOREIGN PATENT DOCUMENTS

WO WO03104740 A1 12/2003

OTHER PUBLICATIONS

International Application No. PCT/US2016/027900, Notification of Transmittal of the International Search Report and the Written Opinion of the International Searching Authority, dated Jul. 26, 2016, 12 pages.

*Primary Examiner* — Gabriel Klein
(74) *Attorney, Agent, or Firm* — Fish & Richardson P.C.

(57) ABSTRACT

The disclosure features firearm cleaning tools that include a planar tool body having a length and width that exceed a thickness of the tool body and comprising a first end, a second end, and a middle portion extending within a plane defined by the tool body along a first direction between the first and second ends. The first end features two arms forming a U-shaped portion and defining a recess in the tool body and an angled projection extending in the plane, and the second end features a tab extending from the second end in the first direction and having a width measured in the plane and in a direction orthogonal to the first direction that is less than a width of the middle portion measured in the plane and in the direction orthogonal to the first direction.

20 Claims, 12 Drawing Sheets

(56) References Cited

U.S. PATENT DOCUMENTS

| | | | | |
|---|---|---|---|---|
| 2012/0186127 | A1* | 7/2012 | Shipman | F41A 29/02 42/95 |
| 2014/0158162 | A1 | 6/2014 | Brooker | |
| 2015/0308686 | A1* | 10/2015 | Hensley | F41A 29/02 42/90 |

* cited by examiner

FIREARM CLEANING TOOL

CROSS-REFERENCE TO RELATED APPLICATIONS

This application claims priority to U.S. Provisional Patent Application No. 62/148,124, filed on Apr. 15, 2015, the entire contents of which are incorporated herein by reference.

TECHNICAL FIELD

This disclosure relates to a tool for cleaning firearms and methods of use therefor.

BACKGROUND

Firearm maintenance is a periodic preventive maintenance procedure to ensure the proper function of a firearm. Typically, firearm maintenance is performed by the owner of the firearm using simple methods such as cleaning the firearm with gun oils, and lubricating with similar oils and greases.

In general, different makes and models of firearms require different maintenance and cleaning techniques. Every major firearms manufacturer provides detailed information on the proper methods used to disassemble, clean, and reassemble a firearm they produce. This information is usually packaged with the firearm. For safety reasons the manufacturer's directions for cleaning, maintenance, and care should always be followed, and a firearm should always be kept in a clean and maintained state.

SUMMARY

This disclosure relates to a firearm cleaning tool, uses thereof, and a method for manufacturing the tool.

In an exemplary implementation, a firearm cleaning tool includes a flat tool body having a first end and a second end, where the first end is formed as a block-U portion having a shape and dimensions to slip-fit a portion of a firearm bolt such that an interior portion of the block-U portion sufficiently contacts a surface of the firearm bolt portion to remove particulate matter adhering to the firearm bolt portion surface when the firearm bolt portion surface is rotated relative to the interior portion of the block-U portion; and where the second end of the flat tool body has a width configured to slip-fit inside a recess of a firearm bolt carrier such that, when the second end of the flat tool body is inserted in the firearm bolt carrier, rotation of the flat tool body causes the second end to remove particulate matter adhering to a surface of the firearm bolt carrier recess.

The firearm cleaning tool may further include a firing pin cleaner formed as a triangular member extending from a side of the flat tool body, where a base length of the triangular member is substantially equal to a radial dimension of a firing pin of the firearm.

The firearm cleaning tool may further include a cleaning patch eyelet formed in the second end of the flat tool body and configured to receive and hold a cleaning patch while the second end is inserted in the firearm bolt carrier.

A tail end of the second end of the firearm cleaning tool can be formed as a tab such that the tail end of the tool, when inserted in the firearm bolt carrier, reaches a bolt tail hole within the bolt carrier to assist in pushing out takedown pins for firearm disassembly.

The firearm cleaning tool can be formed of one or more of stainless steel 316, stainless steel 304, titanium, aluminum, or plastic, or any other suitably strong and resilient material. Dimensions of the firearm cleaning tool may be compatible with various different firearms such as an M-4 carbine, M-16 rifle, an AR15 rifle, an AR10 rifle, or essentially any other firearm.

Methods of cleaning a firearm can involve using the above-described firearm cleaning tool, for example, using the block-U portion of the first end to clean a firearm bolt portion, using the second end to clean a recess of a firearm bolt carrier, and/or using the firing pin cleaning to clean a radial surface of a firing pin.

Methods of manufacturing a firearm cleaning tool can involve forming a flat tool body having a first end and a second end, where the first end is formed as a block-U portion having a shape and dimensions to slip-fit a portion of a firearm bolt such that an interior portion of the block-U portion sufficiently contacts a surface of the firearm bolt portion to remove particulate matter adhering to the firearm bolt portion surface when the firearm bolt portion surface is rotated relative to the interior portion of the block-U portion; and forming the second end of the flat tool body to have a width configured to slip-fit inside a recess of a firearm bolt carrier such that, when the second end of the flat tool body is inserted in the firearm bolt carrier, rotation of the flat tool body causes the second end to remove particulate matter adhering to a surface of the firearm bolt carrier recess.

In another exemplary implementation, the firearm cleaning tool includes a planar tool body having a length and width that exceed a thickness of the tool body and featuring a first end, a second end, and a middle portion extending within a plane defined by the tool body along a first direction between the first and second ends; where the first end features two arms forming a U-shaped portion and defining a recess in the tool body that is dimensioned to receive and contact a portion of a firearm bolt to facilitate cleaning of the firearm bolt; where the second end features a tab extending from the second end in the first direction and having a width measured in the plane and in a direction orthogonal to the first direction that is less than a width of the middle portion measured in the plane and in the direction orthogonal to the first direction; and where the first end features an angled projection extending in the plane from one of the two arms, and is oriented to facilitate cleaning of a firing pin of a firearm.

A width of the angled projection measured in the plane in the direction orthogonal to the first direction may be about equal to a radial dimension of a firing pin of a firearm. A width of the angled projection measured in the plane in the direction orthogonal to the first direction may be about 0.50 inches or less. A width of the angled projection measured in the plane in the direction orthogonal to the first direction may be about 50% or less of the width of the middle portion.

The firearm cleaning tool may include an aperture formed in the middle portion proximal to the second end, and positioned to receive a cleaning patch and hold the cleaning patch when the second end is inserted into a bolt carrier of a firearm.

A length of the tab, measured in the plane along the first direction, may correspond to a distance that is at least sufficient so that when the tab is inserted into a firearm bolt carrier, the tab extends into a bolt tail hole within the firearm bolt carrier.

A width of the tab may be about 50% or less of the width of the middle portion. A width of the tab may be about 0.25 inches or less.

The firearm cleaning tool may be formed of one or more of stainless steel, titanium, aluminum, and plastic.

The tab may have a square or rectangular shape. The tab may include an angled projection extending from the second end. At least one edge of the tab may be sharpened to form a cutting surface. The tab may include two sharpened edges that intersect at a terminal point of the tool.

A bottom surface of the recess may be curved and may form a convex projection extending into a region of the recess that receives the portion of the firearm bolt. A bottom surface of the recess may include two angled surfaces that form an angular projection extending into a region of the recess that receives the portion of the firearm bolt.

Methods of cleaning a firearm can include using any of the firearm cleaning tools disclosed herein to perform any one or more of the following: removing particulate matter from a firearm bolt; cleaning a firing pin of a firearm; and cleaning a bolt recess of a firearm bolt.

All of the features disclosed herein in connection with difference embodiments of firearm cleaning tools can be used interchangeably in combination with one another, unless expressly noted otherwise. Accordingly, this disclosure includes firearm cleaning tools with combinations of features disclosed in different embodiments herein.

As used herein, the term "about"—when used together with a nominal numerical dimension—refers to a range of values that encompasses ±15% of the nominal dimension.

Unless otherwise defined, all technical and scientific terms used herein have the same meaning as commonly understood by one of ordinary skill in the art to which this disclosure belongs. Although methods and materials similar or equivalent to those described herein can be used in the practice or testing of the subject matter herein, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments are set forth in the accompanying drawings and the description below. Other features and advantages will be apparent from the description, drawings, and claims.

DESCRIPTION OF DRAWINGS

Like reference numbers and designations in the various drawings indicate like elements.

DETAILED DESCRIPTION

Figure 1:
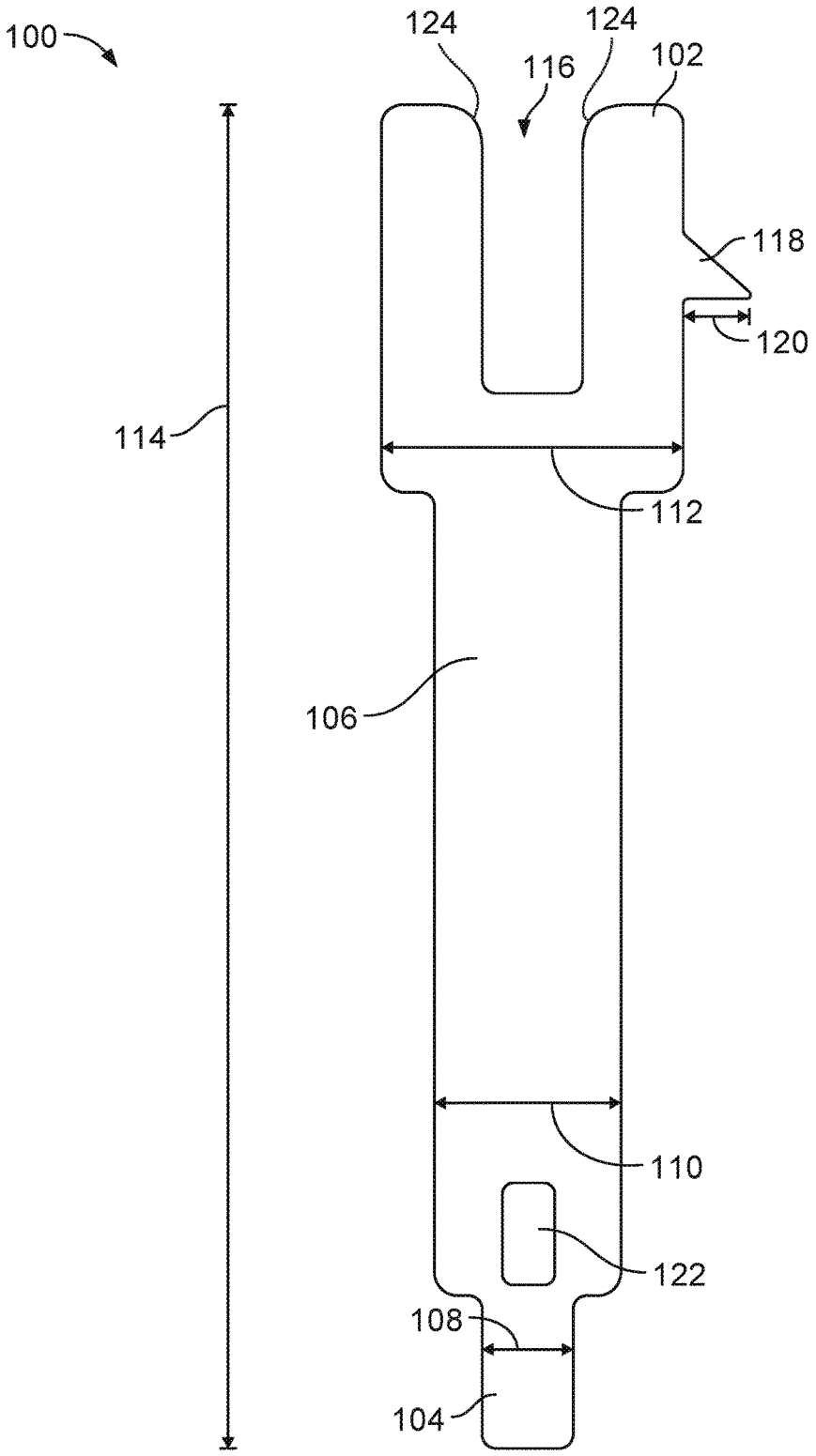
FIG. 1 is a schematic diagram showing a top view of an embodiment of a firearm cleaning tool.
Figure 2:
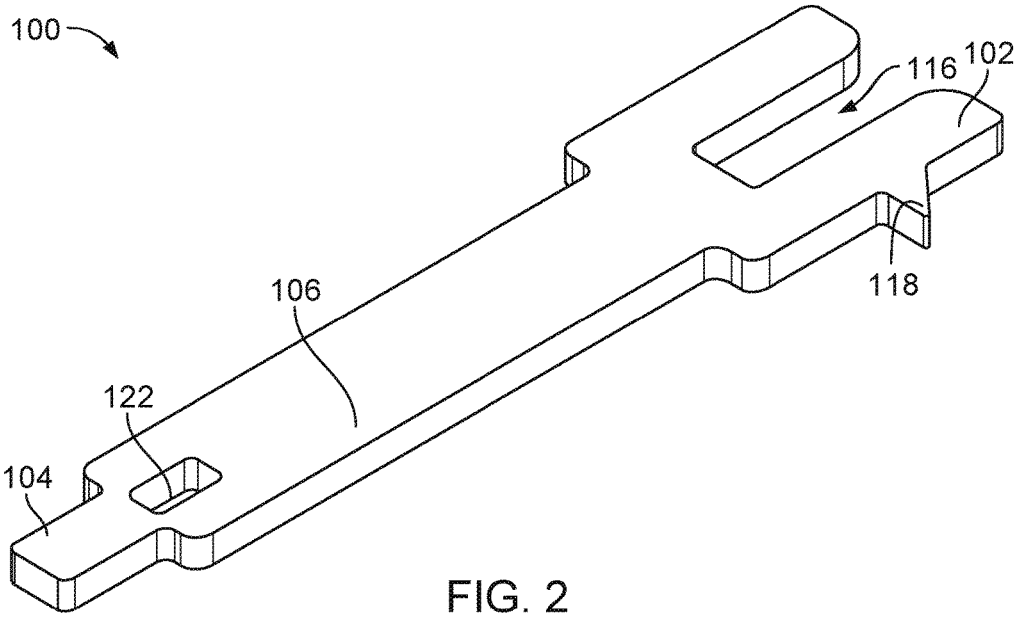
FIG. 2 is a schematic diagram showing an isometric view of the firearm cleaning tool of FIG. 1.
Figure 3:
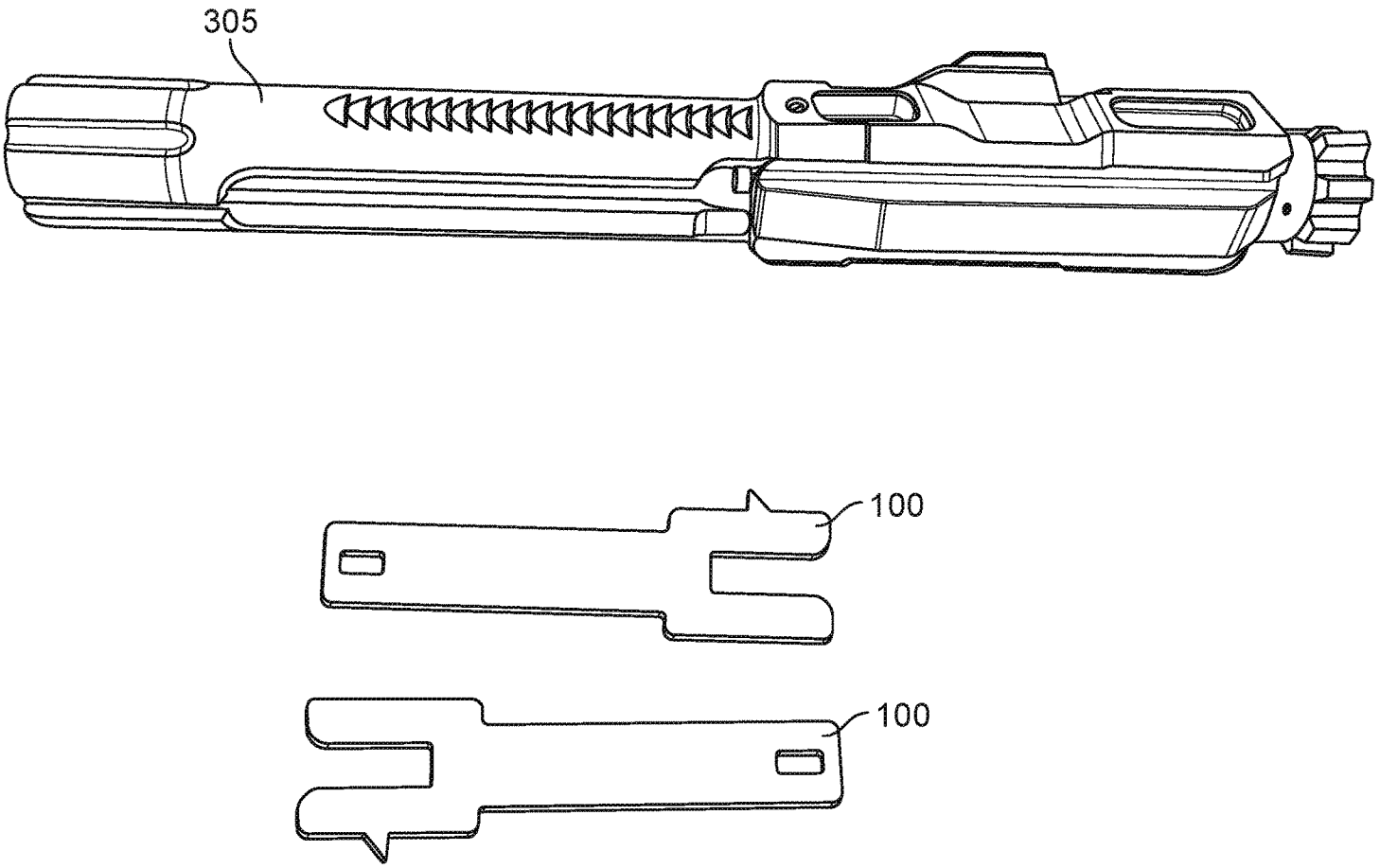
FIG. 3 is a schematic diagram showing a bolt carrier group of a firearm.

FIGS. 1-3 illustrate various views and aspects of a firearm cleaning tool 100. Although the following description is made with reference to a cleaning tool having appropriate dimensions for a M-16/AR-15 platform (5.56 mm cartridge/.223"), the tool 100 can be modified as needed to fit other makes and models of firearms platforms (e.g., AR-10, 7.62 mm/.308" Winchester cartridge).

As shown in FIGS. 1 and 2, the tool 100 generally has an approximately planar, flat tool body with two opposing ends, and a middle portion extending between the ends. The tool body defines a plane, and a maximum length of tool 100 (length 114 discussed below) is measured in the plane defined by the tool body. Widths of various features of the tool are measured in the plane defined by the tool body, in a direction perpendicular to the direction along which length 114 is measured. The length and width of tool 100 exceed a thickness of the tool body (i.e., the thickness of the tool body is measured in a direction perpendicular to the plane of FIG. 1).

At one end of the tool 100 is a block-U shaped portion 102 and at the other end is a tab 104. The tool is shaped and dimensioned to clean (e.g., scrape) particulate matter such as carbon from various surfaces of firearm component when brought into contact with, and moved relative to (e.g. rotated), those components.

The tool 100 can generally have a variety of dimensions appropriate for use with different firearms platforms. For example, for use with the AR-15 platform, the width 108 of tab 104 can be about 0.25 inches, the width 110 of middle portion 106 of tool 100 can be about 0.463 inches, the width 112 of portion 102 can be about 0.748 inches, and the length 114 of tool 100 can be about 3.35 inches.

The tool 100 can be formed from a variety of different materials using standard machining techniques such as cutting, grinding, and extrusion. Suitable materials include, but are not limited to, stainless steel (e.g., stainless steel 316, stainless steel 304), titanium, aluminum, and/or plastic.

Tool 100 can include a variety of different features. In some embodiments, the profile of the block-U shaped portion 102 of the tool 100 is shaped and dimensioned such that it slip-fits (i.e., matches) the backside of the bolt of the firearm model for which the tool was designed, e.g., an AR-15 in this example. As discussed below, the bolt backside portion is inserted into interior recess 116 such that walls of recess 116 come into contact with the surface of the bolt backside portion. Then, a user of the tool 100 causes the tool 100 to move (e.g., rotate) relative to the bolt backside portion, effectively scraping off any carbon or other particulate matter adhering to the surface of the bolt backside portion.

In some embodiments, tool 100 includes a projection 118 that can function as a firing pin cleaner and/or as a firing pin retaining pin remover. In FIG. 1, projection 118 is formed as a triangular member (in this case, a right triangle) that extends from the body of the tool 100 and terminates at a sharp point. The length 120 of the base of the triangular member is such that it matches, or substantially so, a radial dimension of a firing pin surface, as described further below. More generally, projection 118 can have a variety of shapes, including angled projections with 2 or more sides (e.g., 3 or more sides, 4 or more sides, 5 or more sides). In some embodiments, projection 118 can have a rectangular or square shape, or have one or more curved surfaces. A triangular projection, as shown in FIG. 1, can be particularly useful for cleaning a firing pin, and at the same time, implementing a pointed end for use in removal of a firing pin retaining pin.

As shown in FIG. 1, projection 118 extends in a lateral direction relative to one of the arms that form the U-shaped portion 102 of tool. In some embodiments, the maximum width 120 of projection 118 in the lateral direction (i.e., in a direction perpendicular to the direction of maximum length 114 of tool 100) is about 50% or less (e.g., 40% or less, 30% or less, 20% or less, 10% or less) of the maximum width 112 of the U-shaped portion 102 of tool 100. For example, the maximum width 120 of projection 118 in the lateral direction can be about 0.50 inches or less (e.g., about 0.40 inches or less, about 0.30 inches or less, about 0.25 inches or less, about 0.20 inches or less, about 0.15 inches or less, about 0.10 inches or less).

To implement the functionality discussed above and ensure sufficient mechanical strength, the angle a formed at the tip of projection 118 can be selected as desired. For example, in some embodiments, a is between 60 degrees and 10 degrees (e.g., between 50 degrees and 15 degrees, between 40 degrees and 15 degrees, between 30 degrees and 15 degrees).

In certain embodiments, the middle portion 106 of tool 100 functions as a bolt recess cleaner in which the profile of the middle portion 106 slip-fits inside the bolt recess of the bolt carrier of a firearm for removal of carbon and/or other particulate matter adhering to the surface of the bolt recess. When used in this manner, tool 100 can be used bare, or with a cloth draped over middle portion 106 prior to insertion into the bolt recess. In either case, once inserted into the bolt recess, the tool 100 is moved (e.g., rotated) relative to the bolt such that a surface of the tool 100 (or the cloth, if used) scrapes or rubs against the surface of the bolt recess thereby removing particulate matter and cleaning the bolt recess.

In some embodiments, tool 100 includes a cleaning patch eyelet 122 into which a cleaning patch can be threaded, and once threaded, the tool 100 can be inserted into a bolt recess so that the cleaning patch contacts the bolt recess surface thereby facilitating cleaning of the bolt recess.

In certain embodiments, the upper portions 124 of portion 102 of tool 100 functions as a "bullet button" tool. A bullet button is a device used to semi-permanently fix a magazine in a semiautomatic rifle that was originally built to accept a detachable magazine in order to comply with firearm regulations in California. Where the magazine release has been replaced with a block, the user can remove the magazine by using a bullet button tool. The upper portions 124 of tool 100 can serve this purpose. In some embodiments, projection 118 and/or takedown pin pusher 104 (described in more detail below), as well as other portions of tool 100, can perform this function.

In some embodiments, tool 100 includes a takedown pin pusher 104. When the tool 100 is inserted into the bolt recess of a firearm, the takedown pin pusher 104 assists in pushing out takedown pins to facilitate weapon disassembly.

As shown in FIG. 1, the width 108 of pin pusher 104 (which has the shape of a tab in FIG. 1) is, in general, less than the width 110 of middle portion 106 of tool 100, the widths being measured in the plane defined by tool 100, in a direction orthogonal to the length 114 of tool 100. In some embodiments, width 108 is 50% or less of width 110 (e.g., 40% or less, 30% or less, 20% or less, 10% or less). In certain embodiments, the width 108 of pin pusher 104 can be about 0.40 inches or less (e.g., about 0.35 inches or less, about 0.30 inches or less, about 0.25 inches or less, about 0.20 inches or less, about 0.15 inches or less).

In general, the length of pin pusher 104 (measured in the same direction as length 114 of tool 100) corresponds to a distance that is at least sufficient so that when pin pusher 104 is inserted into a firearm bolt carrier, pin pusher 104 extends into a bolt tail hole within the bolt carrier.

To provide a sense of the relative size of tool 100, FIG. 3 shows two different cleaning tools 100 (front and reverse sides, respectively) adjacent to a bolt carrier group 305 for an AR-15 rifle. The embodiment of cleaning tool 100 shown in FIG. 3 does not include pin pusher 104 shown in FIGS. 1 and 2.

Figure 4A:
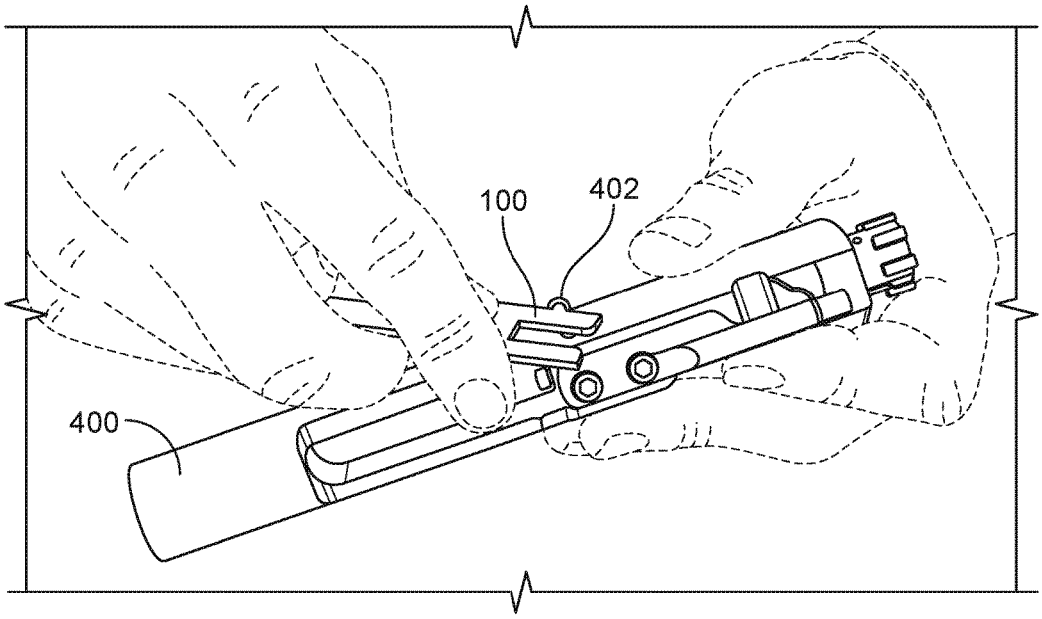
FIG. 4A is a schematic diagram showing the firearm cleaning tool of FIG. 1 used to remove a firing pin retaining pin of a bolt carrier group of a firearm.

FIGS. 4A-4G illustrate firearm cleaning tool 100 being used to clean various components of a bolt carrier group 400 of a firearm. To clean a bolt carrier group 400, it is first disassembled. To do so, as shown in FIG. 4A, firing pin retaining pin remover 118 is used to remove the firing pin retaining pin 402, thereby facilitating disassembly of the bolt carrier group 400.

Figure 4B:
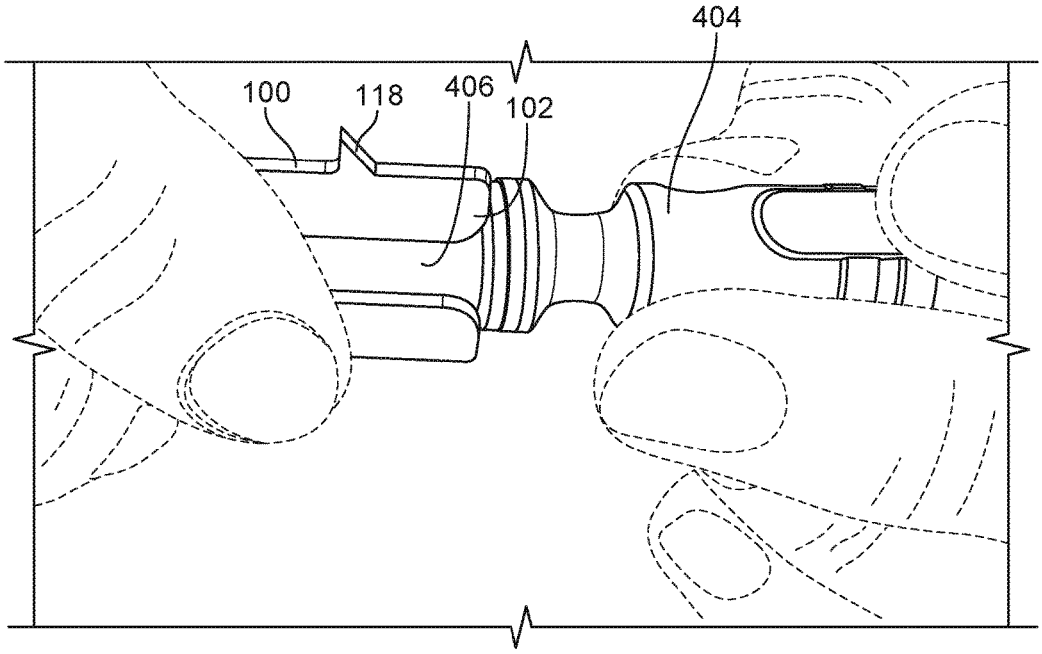
FIG. 4B is a schematic diagram showing the firearm cleaning tool of FIG. 1 used to clean a bolt of a bolt carrier group of a firearm.

In certain embodiments, as shown in FIG. 4B, once the bolt carrier group 400 is disassembled, tool 100 can be used to clean a backside portion 406 of the bolt 404. To do so, a user of tool 100 inserts the bolt portion 406 into recess 116, such that the profile of portion 102 of tool 100 matches, partially encompasses, and comes into contact with bolt portion 406. Then the user rotates the tool 100 relative to the bolt 404 (i.e., either or both of the tool 100 or the bolt 404 may be rotated) to cause an inner surface of recess 116 to scrape against an outer surface of the bolt portion 406, thereby cleaning off carbon or other particulate matter. Note that in FIG. 4B, the profile of portion 102 of tool 100 is shaped and dimensioned such that it matches the contours of the backside bolt portion 406, thereby ensuring a snug slip-fit between the two, which in turn enhances the cleaning effectiveness of tool 100.

Figure 4C:
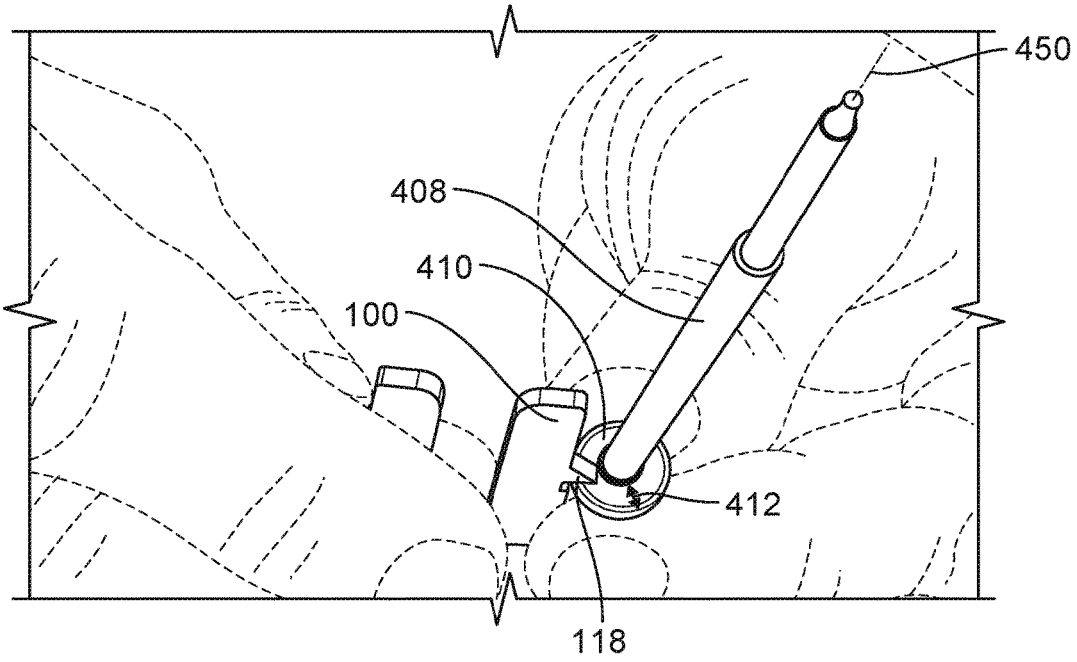
FIG. 4C is a schematic diagram showing the firearm cleaning tool of FIG. 1 used to clean a surface of a firing pin of a firearm.

In some embodiments, as shown in FIG. 4C, the tool's firing pin cleaner (projection 118) can be used to clean a surface 410 of a firing pin 408 of a firearm. To do so, a user of tool 100 places the base of the firing pin cleaner (projection 118) in pressure contact with the firing pin face 410 and then rotates the firing pin 408 relative to tool 100 around the firing pin's axis 450, thereby causing a leading edge of the firing pin cleaner to scrape along the surface of the firing pin face 410 and remove any carbon or other particulate matter adhering thereto. In certain embodiments, as shown in FIG. 4C, the length of the base of the firing pin cleaner 120 matches a radial distance 412 of the firing pin face 410, thereby ensuring a snug fit between the two, which in turn enhances the cleaning effectiveness of tool 100.

Figure 4D:
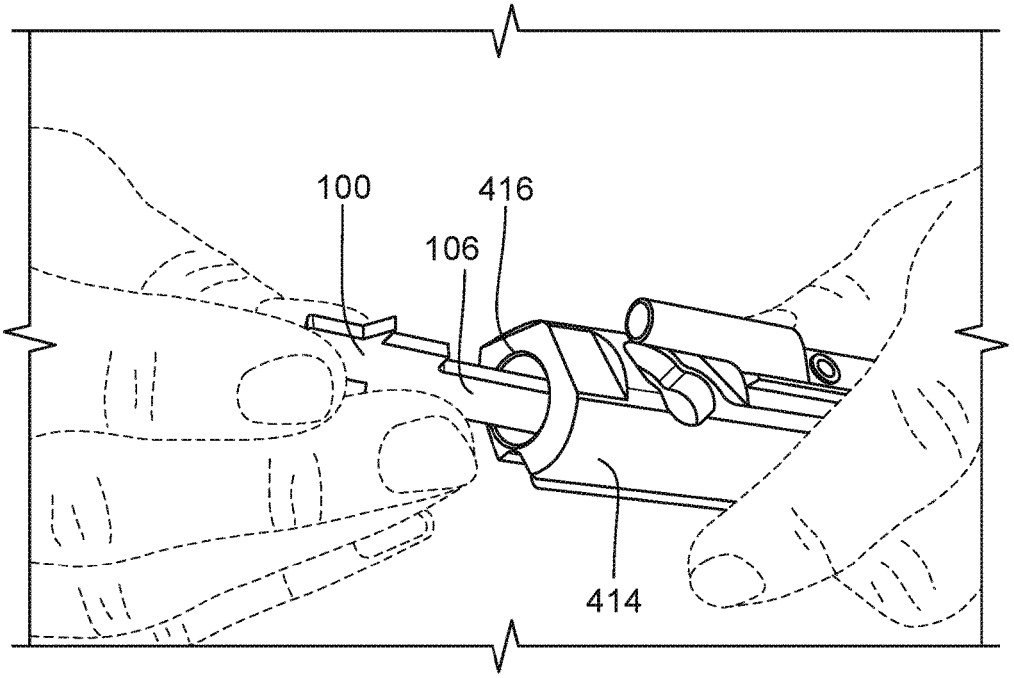
FIG. 4D is a schematic diagram showing the firearm cleaning tool of FIG. 1 used to clean an inside surface of a bolt recess of a firearm.

In some embodiments, as shown in FIG. 4D, the middle portion 106 of tool 100 (which functions as a bolt recess cleaner) can be used to clean an inside surface of a bolt recess 416 in a bolt 414. To do so, a user of the tool 100 inserts the tool 100 inside the bolt recess 416 such that the bolt recess cleaner (middle portion 106), or at least a portion thereof, is inside the bolt 414, and the block-U shaped portion 102 of tool 100 remains outside the bolt recess 416, and effectively can serve as a handle or lever by which the user of the tool 100 can exert rotational torque on the tool 100. In its inserted state, the tool's bolt recess cleaner contacts the inside surface of the bolt recess 416. When the user rotates the tool 100 relative to the bolt 414, an edge of the bolt recess cleaner scrapes along the surface, thereby removing carbon or other particulate matter.

Figure 4E:
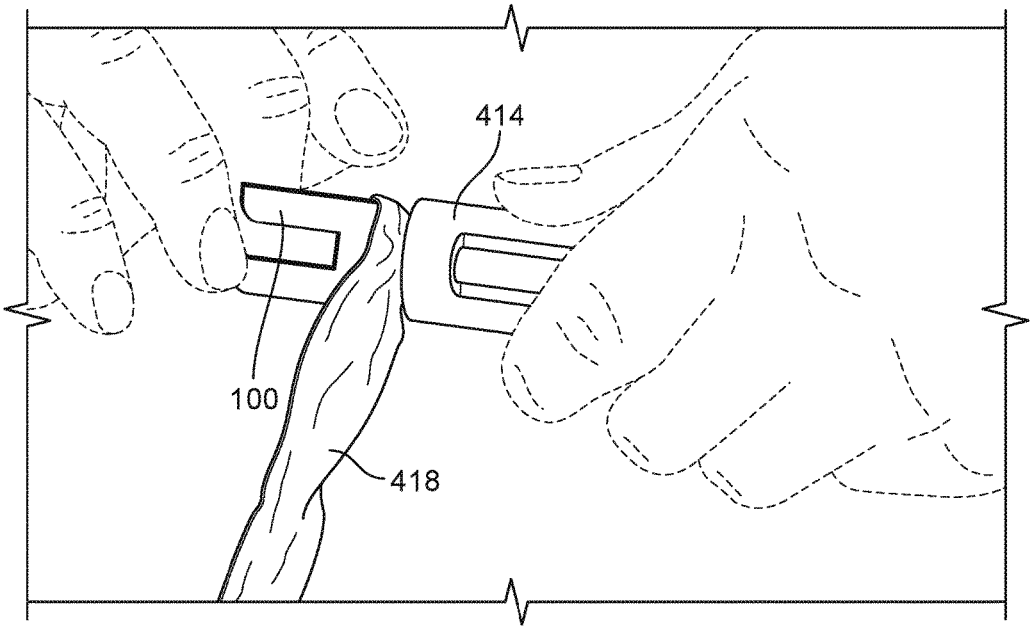
FIG. 4E is a schematic diagram showing the firearm cleaning tool of FIG. 1 used with a cleaning cloth.

The bolt recess cleaner can be used effectively either with or without a cleaning cloth 418 draped over it. FIG. 4D shows usage of the bolt recess cleaner with no cloth. FIG. 4E shows usage with a cloth 418 draped over the bolt recess cleaner prior to insertion into the bolt recess 416. In FIG. 4E, cloth 418 contacts the inside surface of the bolt recess 416, so that there is no direct contact between the bolt recess cleaner and the inside surface of the bolt recess 416. In certain circumstances, usage of the bolt recess cleaner with a cloth, as shown in FIG. 4E, may be more beneficial for polishing the inside surface of the bolt recess 416, rather than scraping it.

Figure 4F:
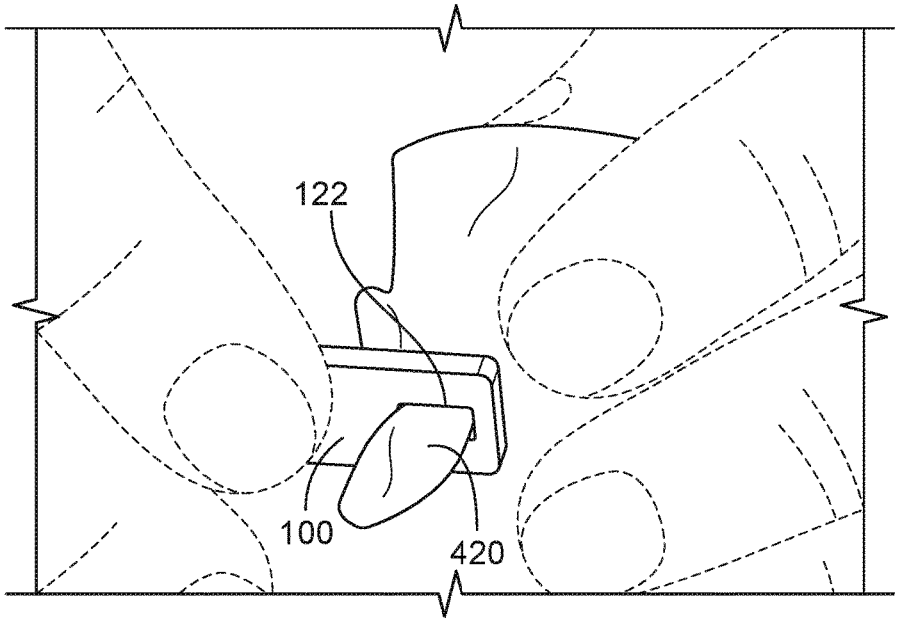
FIG. 4F is a schematic diagram showing insertion of a cleaning patch into an eyelet of the firearm cleaning tool of FIG. 1.
Figure 4G:
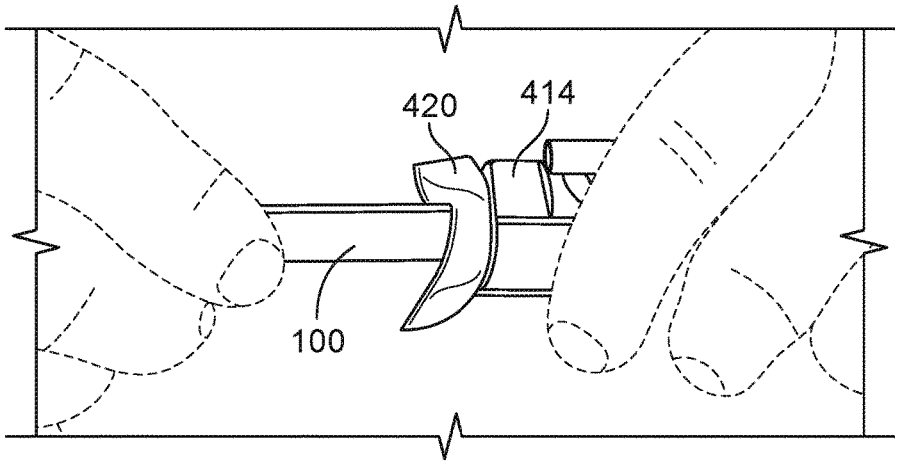
FIG. 4G is a schematic diagram showing the firearm cleaning tool of FIG. 4F used to clean a bolt recess of a firearm.

FIGS. 4F and 4G show how the cleaning patch eyelet 122 can be used to facilitate cleaning of the inside surface of the bolt recess 416. To do so, the user of tool 100 first threads a cleaning patch 420 through eyelet 122 and pulls the cleaning patch to cover the end of tool 100. Then the user inserts tool 100 into the bolt recess 416 of the bolt 414, and twists the tool 100 (and/or the bolt 414) to cause relative rotation of the two. As a result, the cleaning patch 420, which is in the state shown in FIG. 4G, is in contact with the inside surface of the bolt recess 416 and rubs against the surface, thereby cleaning it.

Figure 4H:
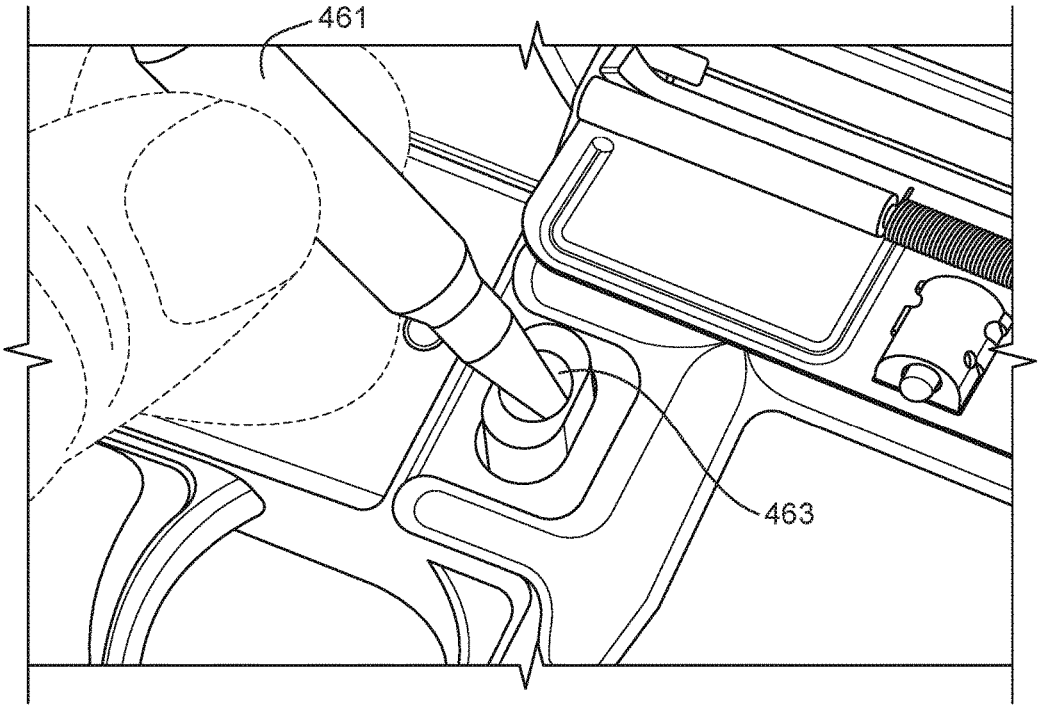
FIG. 4H is a schematic diagram showing the activation of a bullet button of a firearm.

Upper portion 124 of tool 100 can be used to activate a "bullet button" of a firearm, as discussed above. FIG. 4H shows activation of a bullet button 463 using a bullet 461. Upper portion 124 of tool 100 can be used in the same manner as bullet 461 to activate bullet button 463.

Figure 4I:
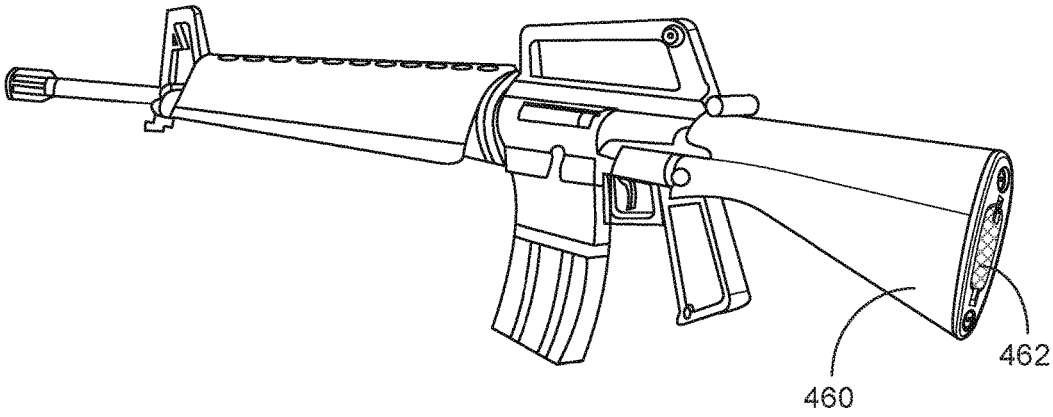
FIG. 4I is a schematic diagram showing a firearm.
Figure 4J:
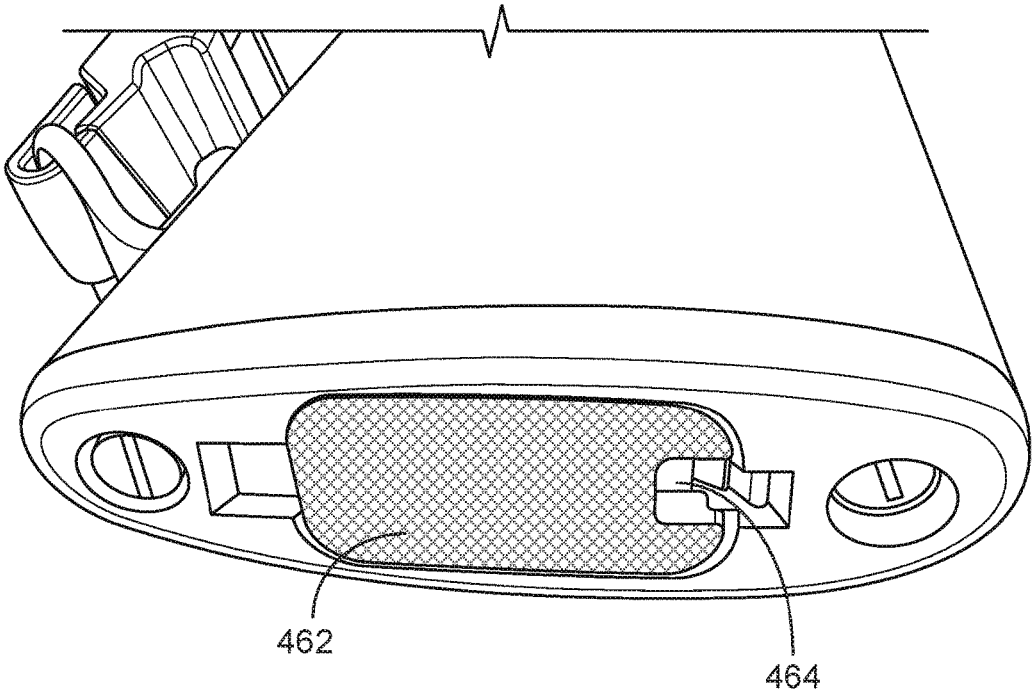
FIG. 4J is a schematic diagram showing a storage compartment within the buttstock of a firearm.

In some embodiments, tool 100 can be stored within a storage area of a firearm. For example, FIG. 4I shows a firearm 460 with a buttstock, and a storage area 462 located within the buttstock. FIG. 4J shows an end view of firearm 460. Storage area 462 features a cover that closes the opening to the storage area, and is activated by locking button 464.

Figure 4K:
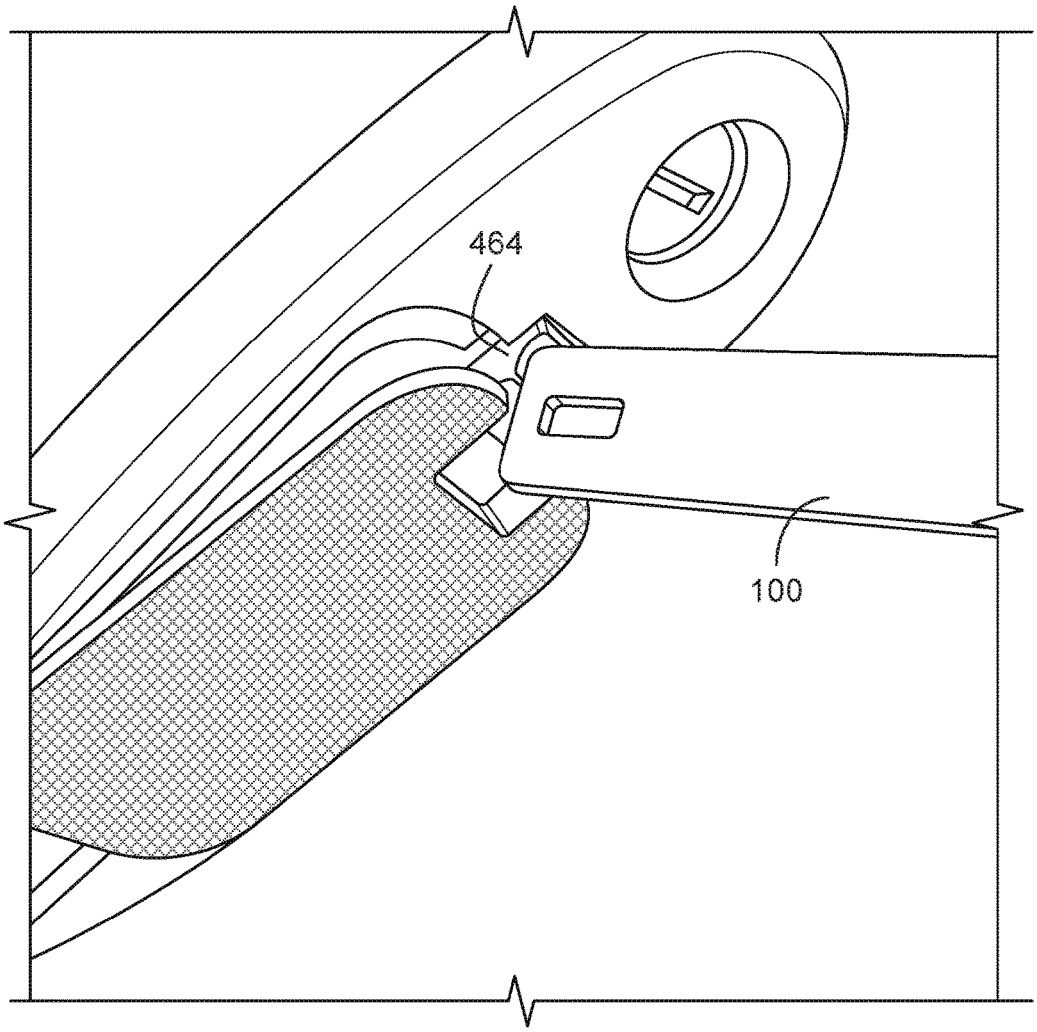
FIG. 4K is a schematic diagram showing the use of the firearm cleaning tool of FIG. 1 to activate a locking button to open the storage compartment of FIG. 4J.
Figure 4L:
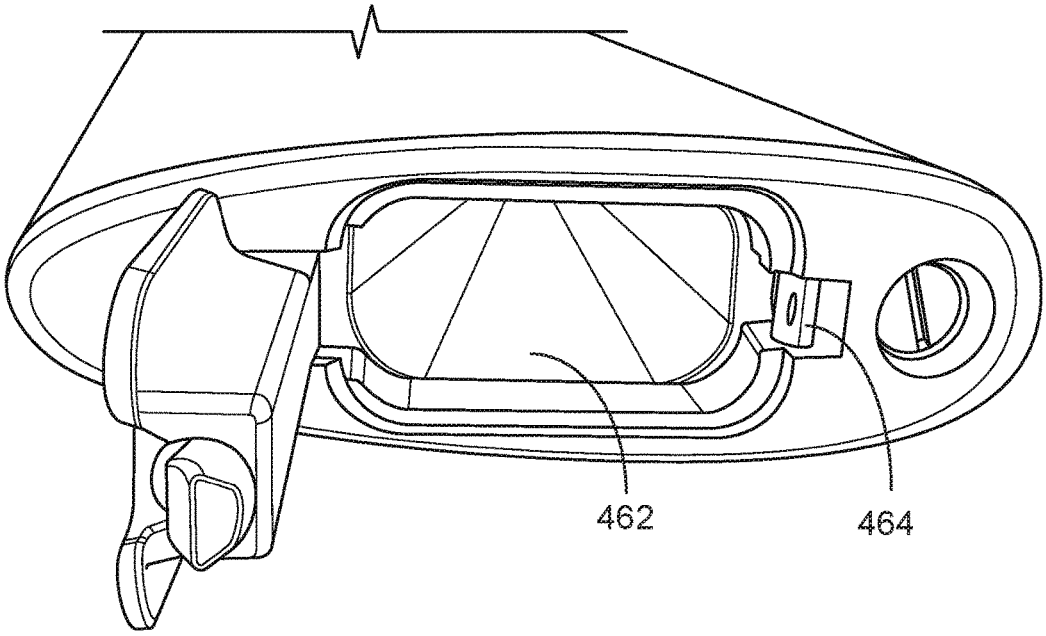
FIG. 4L is a schematic diagram showing the open storage compartment of FIG. 4J.
Figure 4M:
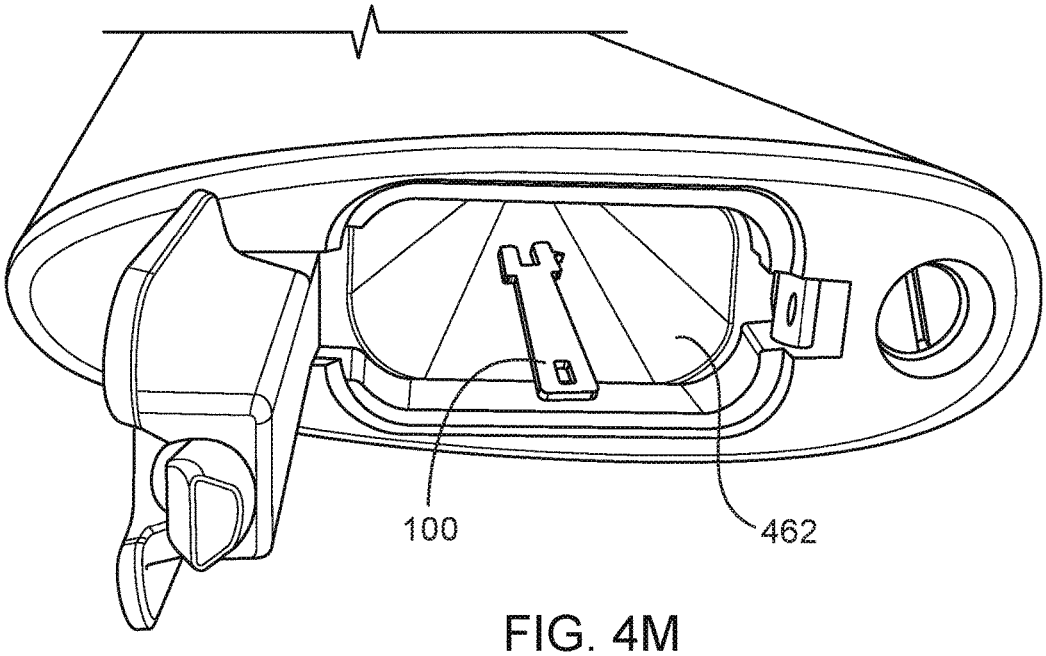
FIG. 4M is a schematic diagram showing the firearm cleaning tool of FIG. 1 stored in the storage compartment of FIG. 4J.

In FIG. 4K, tool 100 is used to activate locking button 464, thereby opening the cover to storage area 462, as shown in FIG. 4L (although tool 100 is not required to activate locking button 464). Tool 100 can be stored in storage area 462, as shown in FIG. 4M.

It should be appreciated that embodiments of tool 100 can include any one or more of, or all, of the features described above, in various combinations. Individual features can be present or absent in different embodiments of tool 100. Tool 100 can also optionally include several other features described below.

Figure 5A:
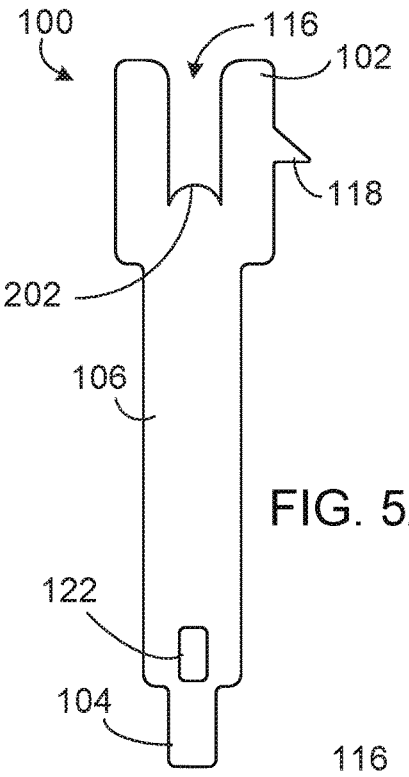
FIGS. 5A-5D are schematic diagrams showing other embodiments of the firearm cleaning tools disclosed herein.
Figure 5B:
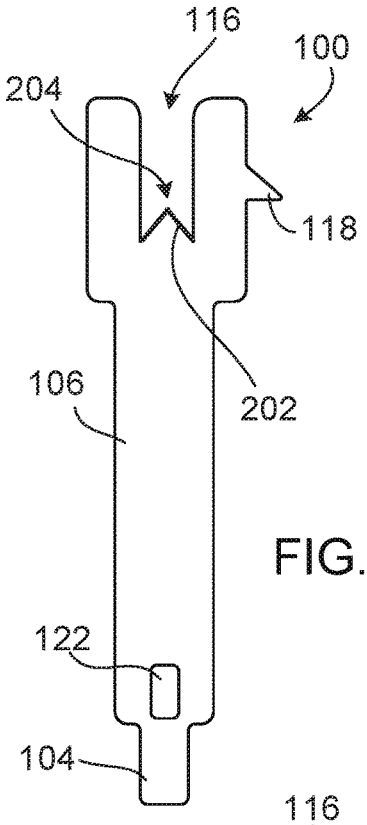

In certain embodiments, the bottom surface of recess 116 in the top portion 102 of tool 100 can have a non-flat profile. When the bottom surface of recess 116 is curved or angled, recess 116 can, in some circumstances, demonstrate improved capture of a firearm bolt when the bolt is twisted, as described above. The bottom surface of recess 116 can have a variety of shapes. In some embodiments, as shown in FIG. 5A, the bottom surface 202 of recess 116 has a curved or "inverted U" shape, extending in a convex direction into recess 116. In certain embodiments, as shown in FIG. 5B, the bottom surface 202 of recess 116 has a pointed or "inverted V" shape, extending upward into recess 116 to a point 204. Other bottom surface shapes within recess 116 can also be used to ensure capture of the firearm bolt.

Figure 5C:
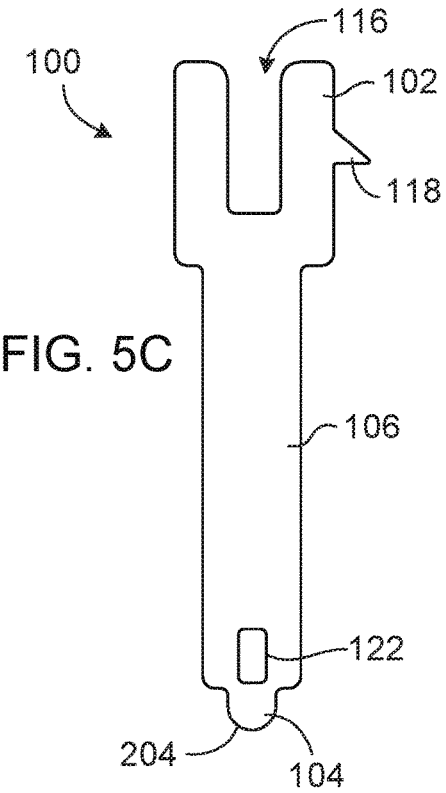

As described above in connection with FIGS. 1-4, tool 100 can optionally include tab 104, which functions as a takedown pin pusher. Tab 104 can also be used to activate a firearm's "bullet button", can to adjust front iron sights up and down on certain types of firearms (e.g., standard issue AR-15 and AR-10 rifles). Tab 104 can have a variety of shapes. For example, as shown in FIG. 1, tab 104 can be rectangular in shape, with square or rounded corners. Alternatively, as shown in FIG. 5C, tab 104 can have an arc-shaped or rounded edge surface (or a partially rounded edge surface) 204, or edge surfaces 204 that terminate at a point (e.g., forming a triangular tab 104). In general, the maximum width 108 of tab 104 can be equal to or less than the width 110 of middle portion 106 of tool 100.

In particular, implementing a tab 104 having a width 108 that is less than the width 110 of middle portion 106 can facilitate access to the bullet button and iron sights of a firearm. In some embodiments, maximum width 108 of tab 104 is 70% or less (e.g., 60% or less, 50% or less, 40% or less, 30% or less) of the width 110 of middle portion 106 of tool 100.

Figure 5D:
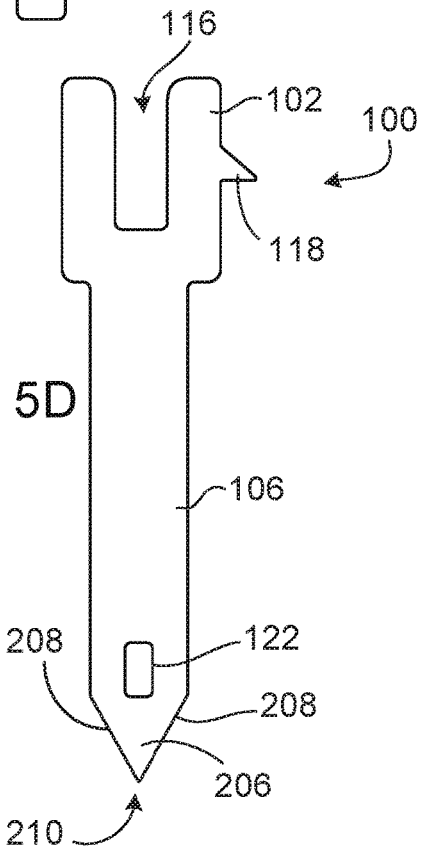

In some embodiments, the lower portion of tool 100 can include an angled projection 206, as shown in FIG. 5D. Angled projection 206 includes edge surfaces 208 that terminate at a point 210. As discussed above in connection with FIG. 5C, angled projection 206 can be used to activate a bullet button and/or adjust a firearm's iron sights. In certain embodiments, one or both edge surfaces 208 can be sharped to form a cutting tool. Further, in some embodiments, angled projection 206 terminates not at point 210 as in FIG. 5D, but at a surface (e.g., a flat surface similar to the bottom surface of tab 104). Thus, angled projection 206 can include a flat bottom surface to implement the functionality discussed above in connection with tab 104, and optionally, one or more sharpened edge surfaces 208 that function as cutting tools.

OTHER EMBODIMENTS

A number of embodiments have been described. Nevertheless, it will be understood that various modifications may be made without departing from the spirit and scope of the disclosure. Accordingly, other embodiments are within the scope of the following claims.

What is claimed is:

1. A firearm cleaning tool, comprising:

a planar tool body having a length and width that exceed a thickness of the tool body and comprising a first end, a second end, and a middle portion extending within a plane defined by the tool body along a first direction between the first and second ends, wherein the width of the middle portion, measured in the plane and in a direction orthogonal to the first direction, is uniform between the first and second ends;

wherein the first end comprises two arms forming a U-shaped portion and defining a recess in the tool body that is dimensioned to receive and contact a portion of a firearm bolt to facilitate cleaning of the firearm bolt;

wherein the second end comprises a tab extending from the second end in the first direction;

wherein a width of the second end, measured in the same direction as the width of the middle portion, is smaller than the width of the middle portion along an entire length of the second end in the first direction; and wherein the first end comprises an angled projection extending in the plane from one of the two arms, and is oriented to facilitate cleaning of a firing pin of a firearm.

2. The firearm cleaning tool of claim 1, wherein a width of the angled projection measured in the plane in the direction orthogonal to the first direction is about equal to a radial dimension of a firing pin of a firearm.

3. The firearm cleaning tool of claim 1, wherein a width of the angled projection measured in the plane in the direction orthogonal to the first direction is about 0.50 inches or less.

4. The firearm cleaning tool of claim 1, wherein a width of the angled projection measured in the plane in the direction orthogonal to the first direction is about 50% or less of the width of the middle portion.

5. The firearm cleaning tool of claim 1, further comprising an aperture formed in the middle portion proximal to the second end, and positioned to receive a cleaning patch and hold the cleaning patch when the second end is inserted into a bolt carrier of a firearm.

6. The firearm cleaning tool of claim 1, wherein a length of the tab, measured in the plane along the first direction, corresponds to a distance that is at least sufficient so that when the tab is inserted into a firearm bolt carrier, the tab extends into a bolt tail hole within the firearm bolt carrier.

7. The firearm cleaning tool of claim 1, wherein the width of the second end is about 50% or less of the width of the middle portion.

8. The firearm cleaning tool of claim 1, wherein the width of the second end is about 0.25 inches or less.

9. The firearm cleaning tool of claim 1, wherein the tool is formed of one or more of stainless steel, titanium, aluminum, and plastic.

10. The firearm cleaning tool of claim 1, wherein the tab has a square or rectangular shape.

11. The firearm cleaning tool of claim 1, wherein the tab comprises an angled projection extending from the second end.

12. The firearm cleaning tool of claim 1, wherein at least one edge of the tab is sharpened to form a cutting surface.

13. The firearm cleaning tool of claim 12, wherein the tab comprises two sharpened edges that intersect at a terminal point of the tool.

14. The firearm cleaning tool of claim 1, wherein a bottom surface of the recess is curved and forms a convex projection extending into a region of the recess that receives the portion of the firearm bolt.

15. The firearm cleaning tool of claim 1, wherein a bottom surface of the recess comprises two angled surfaces that form an angular projection extending into a region of the recess that receives the portion of the firearm bolt.

16. A method of cleaning a firearm, the method comprising using the firearm cleaning tool of claim 1 to perform any one or more of the following:

removing particulate matter from a firearm bolt;

cleaning a firing pin of a firearm; and cleaning a bolt recess of a firearm bolt.

17. A firearm cleaning tool, comprising:

a planar tool body having a length and width that exceed a thickness of the tool body and comprising a first end, a second end, and a middle portion extending within a plane defined by the tool body along a first direction between the first and second ends, wherein the first end comprises two arms forming a U-shaped portion and defining a recess in the tool body that is dimensioned to receive and contact a portion of a firearm bolt to facilitate cleaning of the firearm bolt, the bottom surface of the recess comprising two angled surfaces that form an angular projection extending into a region of the recess that receives the portion of the firearm bolt;

wherein the second end comprises a tab extending from the second end in the first direction and having a width measured in the plane and in a direction orthogonal to the first direction that is less than a width of the middle portion measured in the plane and in the direction orthogonal to the first direction; and wherein the first end comprises an angled projection extending in the plane from one of the two arms, and is oriented to facilitate cleaning of a firing pin of a firearm.

18. The firearm cleaning tool of claim 17, wherein a width of the angled projection measured in the plane in the direction orthogonal to the first direction is about 50% or less of the width of the middle portion.

19. The firearm cleaning tool of claim 17, wherein the width of the tab is about 50% or less of the width of the middle portion.

20. The firearm cleaning tool of claim 17, wherein the tab has at least one of a square shape, a rectangular shape, and a shape corresponding to an angled projection extending from the second end.

* * * * *